US005611872A

United States Patent [19]

Manning et al.

[11] Patent Number: 5,611,872

[45] Date of Patent: Mar. 18, 1997

[54] MAGNETIC STRIPS AND METHODS FOR MAKING THE SAME

[75] Inventors: Neil R. Manning; Richard L. Anderson, both of Marengo, Ill.

[73] Assignee: The Arnold Engineering Company, Marengo, Ill.

[21] Appl. No.: 412,165

[22] Filed: Mar. 28, 1995

Related U.S. Application Data

[62] Division of Ser. No. 114,439, Aug. 30, 1993, Pat. No. 5,431,746.

[51] Int. Cl.[6] ..... H01F 1/147

[52] U.S. Cl. ..... 148/306; 148/307; 340/551; 420/105

[58] Field of Search ..... 148/306, 307; 420/105; 340/551, 572

[56] References Cited

U.S. PATENT DOCUMENTS

| | | | |
|---|---|---|---|
| 1,773,793 | 8/1930 | Sattler | 148/306 |
| 3,445,299 | 5/1969 | Laudenslager et al. | 148/307 |
| 4,059,462 | 11/1977 | Masumoto et al. | 148/306 |
| 4,145,232 | 3/1979 | Solomon | 148/235 |
| 4,152,177 | 5/1979 | Mantel et al. | 148/235 |
| 4,386,972 | 6/1983 | Knight | 148/235 |
| 4,510,489 | 4/1985 | Anderson, III | 340/572 |
| 5,089,061 | 2/1992 | Abe et al. | 148/110 |
| 5,257,009 | 10/1993 | Narlow | 340/572 |
| 5,278,573 | 1/1994 | Silkaria | 343/749 |
| 5,285,194 | 2/1994 | Ferguson | 340/572 |
| 5,313,192 | 5/1994 | Ho et al. | 340/551 |
| 5,341,125 | 8/1994 | Plonsky et al. | 340/572 |
| 5,351,033 | 9/1994 | Liu et al. | 340/572 |
| 5,357,240 | 10/1994 | Sanford et al. | 340/572 |
| 5,367,289 | 11/1994 | Baro et al. | 340/566 |

OTHER PUBLICATIONS

Alban et al., *Heat Treating*, Metals Handbook Ninth Edition, (1981), 135–137.

Araki, et al., *Dependence of Electric and Magnetic Properties of CVD Carbon Films on Heat Treatment Temperature*, Technology Reports of the Osaka University, vol. 40, No. 2015, (1990), pp. 255–265.

Bozorth, R., *Materials for Permanent Magnets*, Ferromagnetism (1951), pp. 374–378.

Brick et al., *Structure and Properties of Engineering Materials*, Iron and Steel Alloys: Low–Carbon Steels (1977) pp. 273–278.

Carpenter Technology Corporation, Alloy Data Sheets (1991).

Cubberly et al., *Properties and Selection: Stainless Steels, Tool Materials and Special Purpose Metals*, Metal Handbook Ninth Edition, vol. 3, (1980) pp. 615–632.

Kinzel et al., *Special Low–Chromium Steels*, The Alloys of Iron and Chromium, vol. 1 (1937), pp. 406–414.

McCraig, M., *Permanent Magnets in Theory and Practice*, Permanent Magnet Materials, (1977), pp. 84–87, 352–353.

Metals Handbook® Ninth Edition, vol. 4 Heat Treating, ASM Heat Treating Division Council, 1981.

New Engineering Opportunities in Specialty Metals, Carpenter Technology Corporation vol. 1, No. 6 (1990).

Standard Specification for Pressure Vessel Plates, Alloy Steel, Chromium–Molybdenum, Annual Book of ASTM Standards, (1991) pp. 257–259.

Takahashi et al., "Cr–Co Steels for Semi–Hard Magnets". Review of Electrical Communications Laboratories; vol. 21, 9–10 (1973), pp. 654–664.

Weymueller, C., Permanent Magnet Materials, Metal Progress, Jan. (1968), pp. 77–87.

*Primary Examiner*—George Wyszomierski

*Attorney, Agent, or Firm*—Woodcock Washburn Kurtz Mackiewicz & Norris

[57] ABSTRACT

Methods for preparing magnetic strips are provided in which the strips are manufactured to a thickness of less than about 0.003 inches and are made of a ferrous alloy having a carbon content of from about 0.4 to about 1.2 weight percent. The strips are prepared by first manufacturing an alloy having a carbon content below about 0.5 weight percent to the desired thickness and then subjecting the strip to a carburizing step to raise the carbon content in the strip.

8 Claims, No Drawings

MAGNETIC STRIPS AND METHODS FOR MAKING THE SAME

This is a division, of application Ser. No. 08/114,439, filed Aug. 30, 1993, now U.S. Pat. No. 5,431,746.

FIELD OF THE INVENTION

The present invention relates to permanent magnetic strips and processes for their preparation. More particularly the invention relates to relatively thin magnetic strips, those having a thickness of below about 0.005 inches.

BACKGROUND OF THE INVENTION

Certain metallic alloy compositions are known for their magnetic properties. Various applications exist for the use of such alloys within industry. The rapidly expanding use of such alloys has also extended into such markets as electronic article surveillance systems. Many of these newer markets require alloys with superior magnetic properties at reduced costs such that the items within which they are employed can be discarded subsequent to their use.

The metallic alloy compositions that constitute permanent magnets are characterized by various performance properties such as coercive level, $H_c$, and residual induction, $B_r$. The coercive level is a measure of the resistance of the magnet to demagnetization and the residual induction is a measure of the level of induction possessed by a magnet after saturation and removal of the magnetic field.

Superior magnetic properties can be obtained by using a ferrous alloy containing chromium and cobalt. However, the presence of cobalt typically makes such alloys prohibitively expensive and thus impractical in various end uses.

Certain of the newer magnetic markets further require the preparation of the alloy into a relatively thin strip of material such that the magnetic properties are provided in an economical fashion. As the demand for increasingly thin magnetic strips increases, the selection of metallic alloys possessing the required magnetic properties while also possessing the necessary machinability and workability characteristics to provide the desired shapes, becomes exceedingly difficult. For example, ferrous alloys having carbon contents of about 1 weight percent and chromium contents of about 3–5 weight percent have been shown to exhibit advantageous magnetic properties. However these alloys are mechanically hard and cannot be rolled easily to the required thickness due to either initial hardness or high levels of work hardening during processing.

A need therefore exists in the permanent magnet art for thin magnetic strips having superior magnetic properties without the need for cobalt and other expensive components in the alloy compositions constituting the magnetic strip. The magnetic strips should be made from alloy compositions which are amenable to processing of the alloy into the thin strips required by many industrial uses, especially those below about 0.005 inches in thickness.

SUMMARY OF THE INVENTION

The present invention provides methods for preparing magnetic strips and also magnetic strips that can be produced by those methods. The magnetic strips can be prepared having a thickness of less than about 0.005 inches, preferably less than about 0.003 inches, and more preferably less than about 0.002 inches. The magnetic strips can also be prepared without the need for cobalt in the alloy, while still providing superior magnetic properties, such that economical products result.

In accordance with preferred embodiments, methods for preparing magnetic strips are set forth in which a ferrous alloy strip is provided containing iron and from 1 to about 15 weight percent chromium. The strip has a carbon content below about 0.5 weight percent and a thickness of less than about 0.005 inches. The strip is then heated at a temperature between about 750° C. and about 1200° C. in a carburizing atmosphere. The heating is continued for a period of time sufficient to raise the carbon content in the strip to between about 0.4 and about 1.2 weight percent.

The initial carbon content of the alloy used to provide the initial strip is selected to be such that the strip can be processed to the desired thickness. The carbon content of the initial strip is preferably below about 0.5 weight percent, preferably from about 0.05 to about 0.3 weight percent, and more preferably 0.1 to 0.25 weight percent. The strips having the selected, relatively low carbon content, are then processed to the desired thickness using conventional processing steps, such as rolling.

The manufacture of strips with the desired thickness having been achieved, the carbon content of the strip is then raised to provide the improved magnetic properties. This step is accomplished by subjecting the strip to a carburizing atmosphere. Preferred carburizing atmospheres are those containing methane as the carbon source, however methanol, ethanol, propanol, ethane, propane, butane, hexane, carbon monoxide and other sources of carbon can also be employed advantageously. Carrier gases such as hydrogen and nitrogen can be used in the carburization process. The carbon content of the strip is raised to a level of from about 0.4 to about 1.2, preferably from about 0.45 to about 1, and more preferably from 0.5 to 0.7, weight percent of the strip composition.

The present invention also provides for the magnetic strips which can be produced by the methods set forth in the present invention.

DETAILED DESCRIPTION OF PREFERRED EMBODIMENTS

The present invention provides relatively thin magnetic strips of ferrous alloy materials and processes for preparing such magnetic strips. The thickness of the magnetic strips is less than about 0.005, preferably less than about 0,003, more preferably less than about 0.002, and in some cases in the range of from 0.0005 to 0.002, inches.

Useful ferrous alloy compositions that possess the desired magnetic properties contemplated by this invention are those having a certain level of carbon. The carbon content for the final magnetic strip is advantageously from about 0.4 to about 1.2, preferably about 0.45 to about 1, and more preferably from 0.5 to 0.7, weight percent. It has been found, however, that a ferrous alloy having such a carbon content exhibits substantial work hardening upon rolling to the desired thickness of the strips contemplated by the present invention. Further, the size of the primary carbide phase present in a ferrous alloy having such a relatively high carbon content is believed to be a severe detriment to achieving the required strip thickness without structural flaws such as visibily observable holes, ridges, or tears. It is thus difficult to achieve strips having, at once, the desired thickness and high magnetic properties from a particular base alloy. The processes of the present invention provide magnetic strips having the desired thicknesses along with the desired carbon content with concomitant magnetic properties.

It has been found that the required thickness for the magnetic strip can be obtained by first rolling a ferrous alloy having a lower carbon content than that desired for the finished strip. The carbon content is then raised in the magnetic strip by a carburizing process to produce a final strip material having both the required thickness and the desired magnetic properties.

The ferrous alloy composition of the material employed to provide the initial magnetic strip having the required thickness is one containing up to about 0.5, preferably up to about 0.3, more preferably from about 0.05 to about 0.3, and even more preferably from 0.1 to 0.25, weight percent carbon. This alloy can further contain other elements useful to enhance the magnetic properties of the alloy such as chromium in an amount of from about 1 to about 15, preferably from about 2.5 to about 7, and more preferably from 3.5 to 5, weight percent. Molybdenum may also be present in an amount of up to about 4, preferably from 0.1 to about 2, and more preferably from 0.5 to 1, weight percent of the initial strip alloy. Vanadium may also be present in this strip alloy in an amount of up to about 1, preferably from about 0.05 to about 0.7, and more preferably from 0.1 to 0.5, weight percent. Other elements such as manganese in an amount of up to about 1.5, preferably from about 0.3 to about 1.2, and more preferably from 0.5 to 1, weight percent and silicon in an amount of up to about 1.5, preferably from about 0.3 to about 1, and more preferably from 0.5 to 1, weight percent may also be present in the initial strip alloy. Mixtures of the foregoing may be used and other compounds not interfering with the achievement of the objects of the invention may also be included.

The balance of the alloy that is used to manufacture the thin sheets of magnetic strip material is preferably composed essentially of iron except for the usual impurity elements found in commercial grades of iron alloys. The levels of these elements are preferably controlled to ensure that they do not detract significantly from the performance characteristics of the magnetic strip. In this regard, it is generally preferred to maintain the level of such elements as Ni below about 0.3 wt. %, Cu below about 0.2 wt. %, P and N below about 0.025 wt. %, O, S, Al, and H below about 0.015 wt. %.

One preferred alloy composition for conventional magnetic applications is an alloy having 0.15–0.22 wt. % C, 0.5–1.0 wt. % Mn, 3.5–4.5 wt. % Cr, 0.4–0.65 wt. % Mo, 0.5–1 wt. % Si, with the balance essentially iron. The level of such elements as S, P, Ti, Cu, Al, Ni, Co, W, V, Cb, H, O, and N is preferably maintained as low as possible, such as below 0.3 wt. % Ni, Co, and W; below 0.2 wt. % Cu, below 0.025 wt. % P and N, and below 0.015 wt. % for O, Ti, Al, S, Cb, and H.

The alloy compositions can also contain cobalt, although not preferred due to its expense, in an amount of below about 20, preferably from about 0.1 to about 10, percent by weight. The coercivity of the magnetic strips prepared from the base alloy can be improved by the incorporation of such elements as W, Ti, and Cb. The W can be present in an amount up to about 6 wt. %, preferably from about 0.1–4 wt. % of the alloy composition. The Ti can be present in an amount up to about 2 wt. %, preferably from about 0.1–1 wt. %, and the Cb can be present in an amount up to about 5 wt. %, preferably from about 0.1 to about 4 wt. % of the alloy composition.

The initial ferrous alloy composition is processed into the desired thickness forming the initial strip. Typically, the composition is processed into sheets or strips by conventional rolling techniques known to those of skill in the metal processing industry.

The magnetic strip, processed to its desired thickness, is then subjected to a carburization process. The overall carbon content of the magnetic strip alloy is thus raised to the level desired for a particular application. The final carbon content can be conveniently adjusted to produce a magnetic strip having the desired magnetic properties.

The carburization process can be conducted by any of the various methods known to those of skill in the art, such as gaseous and liquid carburization. Generally, using gaseous carburization, the low carbon magnetic strip is placed into a gaseous carburizing atmosphere at an elevated temperature for a time sufficient to raise the carbon content to the desired level. For example, a strip annealing furnace can be used as a means for providing a gaseous carburizing atmosphere to the low carbon ferrous alloy strip. The carburizing atmosphere is typically maintained at a temperature of from about 800° C. to about 1200° C., preferably from about 850° C. to about 1100° C. The preferred gaseous composition supplied to the carburizing atmosphere contains methane as a source of the carbon. The methane can be introduced along with a carrier gas, such as hydrogen or nitrogen, with the methane concentration being from about 5 to about 25 vol.%, preferably from about 10 to about 20 vol. %, and more preferably about 15 vol. %, all measured at standard temperature and pressure (STP) conditions. Various other gaseous compositions containing carbon can also be employed in the carburizing process such as ethane, propane, butane, hexane, methanol, ethanol, propanol, and carbon monoxide, and mixtures thereof. Carrier gases such as those known in the art, for example, carrier gas classes 201, 202, 302, and 402 can be utilized as set forth in Metals Handbook®, Ninth Edition, Vol. 4 (1981), American Society for Metals, pages 135–137, which is herein incorporated by reference.

The magnetic strips can be presented in the carburizing atmosphere in various configurations. It is preferred, however, that the upper and lower faces of the strip both be exposed to the carburizing atmosphere, preferably for the same amount of time, to ensure homogeneity of the carbon content within the cross-section of the strip. The duration of time that the magnetic strip is exposed to the carburizing atmosphere depends upon the geometry and the extent of carburization necessary, however typical residence times are below about 5 minutes, generally from about 1 to about 2 minutes.

The carbon content of the carburized magnetic strip is raised to a level of from about 0.4 to about 1.2, preferably from about 0.45 to about 1, and more preferably from 0.5 to 0.7, weight percent. This level of carbon content has been found to produce a thin magnetic strip having superior magnetic properties. The carbon content in the strip is generally raised by at least about 20, preferably by at least about 50, and more preferably from about 100 to about 1000, weight percent during the carburization process.

The magnetic properties of the strip can be further enhanced by conventional post carburization heat treatment. The preferred phase of the alloy is the martensite phase. This phase can be obtained, for example when the gaseous carburization process is employed, by subjecting the carburized alloy, generally in the austenite phase, to a quenching step following the carburization. This quenching step is generally accomplished by cooling the heated alloy from the elevated carburization temperature to about ambient, generally from 25°–35° C., in less than about 1 minute, prefcrably less than about 45 seconds, and more preferably less than about 30 seconds. This quenching step avoids the formation of undesired metallic phases. The strip can be further treated by a tempering process to stabilize the martensite and enhance its ductility. The tempering can be accomplished by heating the strip alloy to about 350°–425° C. for about 1–2 hours in an atmosphere such as argon with about 3–4% vol. (STP) hydrogen. Then, the strip alloy can be reaustenitized by subjecting the strip to temperatures of from about 870° C. to about 925° C. for a time sufficient to heat the alloy to that temperature, for example from about 0.1 to about 1 minute. The strip can be tempered an additional time at about 350°–425° C. for about 1–2 hours. The tempering process is useful to convert the retained austentite into the martensite phase and to reduce the brittleness of the alloy.

The magnetic properties of the finished magnetic strip are such that it has typical coercive levels, $H_c$, of from about 20 to about 100 oersteds, the exact level being application specific. The residual induction, $B_r$, of the magnetic strip is typically from about 7000 to about 13,000 gauss.

EXAMPLES

Example 1

A magnetic strip was prepared in accordance with the invention by processing a ferrous alloy having a carbon content of about 0.14 wt. % to the desired thickness of about 0.002 inches and then carburizing the strip to increase the carbon content to about 0.5 wt%.

A 0.19 inch thick steel plate was rolled down to 0.002 inches by standard cold rolling techniques with process annealing as necessary. The alloy, designated as A3 alloy, had an elemental composition, on a weight basis, of: 4.4% Cr, 0.14% C, 0.52% Mo, 0.44% Mn, 0.27% Si, 0.13% Cu, 0.12% P, 0.006% S, 0.18% Ni, and 0.018% V, with the balance essentially iron. The strip was then passed through a horizontal strip annealing furnace with a 7 foot long hot zone maintained at about 1065° C. at a speed of about 5 ft/min., yielding a residence time of about 1.4 minutes in the hot zone. A gaseous mixture of 15% volume (STP) methane in hydrogen was fed into the carburizing zone of the furnace. The carbon content of the strip, now in the austentite form, exiting the furnace was about 0.5 wt. %.

The hot carburizing zone of the furnace was immediately followed by a quenching zone that transformed the alloy from the austentite to martensite phase, the desired magnetic phase. The quenching zone was operated at a temperature of about 30° C., the furnace being at that temperature within about a foot from the end of the hot zone, and the strip was cooled to that temperature within about 0.2 minutes.

The strip was then tempered in a batch furnace for about 1.5 hours at a temperature of 400° C. in an atmosphere containing argon with 3.8% vol. (STP) hydrogen. The strip was then cooled and reaustenitized by running the strip through the strip annealing furnace again, with the temperature in the hot zone maintained at about 900° C., at a rate of 35 ft./min. in a hydrogen atmosphere. The residence time was about 0.2 minutes at the elevated temperature. The strip was again tempered for 1.5 hours at 400° C. in the argon/3.8% hydrogen atmosphere.

The strip had a coercive level, $H_c$, of about 45 oersteds and a residual induction, $B_r$, of about 10,400 gauss.

Example 2

A second magnetic strip was prepared from an alloy designated as A2 alloy having a weight composition of 13.3% Cr, 0.32% C, 0.66% Mn, 0.66% Si, 0.008% Al, 0.012% P, 0.001% S, and 0.003% Sn. The material was rolled down to 0.002" and cut into suitably sized pieces. The material was then loaded into a tube furnace and heated in hydrogen. When the temperature reached 1750° F., an atmosphere of hydrogen and 5% methane was introduced for 10 minutes, then flushed with argon and quenched. The resulting carbon concentration in the strip was between 0.56 and 0.60 weight percent. The A2 alloy was also treated in the same way but without the methane addition for control purposes. The two sets of strips were then tempered at different temperatures and the magnetic characteristics compared as shown in Table I below.

The A3 alloy of Example 1 was processed according to the procedures set forth in Example 1 with the residence time in the carburizing atmosphere and the tempering conditions varied. The residence time was decreased for one set of strip components to yield strips having a carbon content of about 0.25–0.27 wt. % as controls and the residence time was increased to yield strips having a carbon content of about 0.69 wt. % for examples representative of the present invention. These two sets of strips were then tempered at different temperatures and the magnetic characteristics compared as shown in Table I below.

The coercivities of the carburized strips were found to be higher than the uncarburized ones. The remanences of the carburized strips, however, were found to be generally less than the uncarburized strips.

| Alloy | Carbon content (wt. %) | Coercivity (Hc, in Oe) | Remanance (Br, in KG) | Thickness (inches) | Tempering Conditions |
|---|---|---|---|---|---|
| A3 | 0.256 | 31 | 6.6 | 0.0018 | Not Tempered |
| A3 | 0.698 | 34–36 | 5.7–6.0 | 0.0018 | |
| A3 | 0.272 | 29–30 | 6.3–6.4 | 0.0016 | Not Tempered |
| A3 | 0.6995 | 33–34 | 4.5–4.7 | 0.0016 | |
| A3 | 0.256 | 21–22 | 6.6 | 0.0018 | Tempered at |
| A3 | 0.6998 | 38 | 6.5–7.1 | 0.0018 | 400° C. |
| A3 | 0.272 | 21–22 | 6.5 | 0.0016 | Tempered at |
| A3 | 0.6995 | 38 | 6.0–6.2 | 0.0016 | 400° C. |
| A2 | 0.35 | 65 | 6.8 | 0.002 | Not Tempered |
| A2 | 0.60 | 80 | 6.4 | 0.002 | |
| A2 | 0.35 | 60 | 7.2 | 0.002 | Tempered at |
| A2 | 0.60 | 81 | 6.3 | 0.002 | 200° C. |
| A2 | 0.35 | 60 | 7.2 | 0.002 | Tempered at |
| A2 | 0.60 | 78 | 7.0 | 0.002 | 315° C. |
| A2 | 0.35 | 62 | 7.3 | 0.002 | Tempered at |
| A2 | 0.60 | 73 | 7.2 | 0.002 | 370° C. |
| A2 | 0.35 | 58 | 7.6 | 0.002 | Tempered at |
| A2 | 0.60 | 72 | 7.1 | 0.002 | 425° C. |
| A2 | 0.35 | 50 | 7.6 | 0.002 | Tempered at |
| A2 | 0.60 | 65 | 7.4 | 0.002 | 480° C. |
| A2 | 0.35 | 15 | 7.8 | 0.002 | Tempered at |
| A2 | 0.60 | 65 | 7.4 | 0.002 | 540° C. |

What is claimed is:

1. A thin magnetic strip that exhibits superior magnetic properties, comprising a ferrous alloy strip having a thickness of between 0.0005 and 0.003 inches, said strip consisting essentially of iron, from about 0.45 to about 0.7 weight percent carbon, from about 2.5 to about 7 weight percent chromium, from about 0.1 to about 2 weight percent molybdenum, and optionally from about 0.05 to about 0.7 weight percent vanadium, from about 0.3 to about 1.2 weight percent manganese, and from about 0.3 to about 1 weight percent silicon, said strip being essentially free of cobalt, said strip having a coercive level of at least about 35 oersteds and a residual induction of at least 7,000 gauss.

2. The thin magnetic strip of claim 1 having a coercive level of at least 40 oersteds.

3. The thin magnetic strip of claim 2 having a residual induction of at least 9000 gauss.

4. The thin magnetic strip of claim 2 having a coercive level of at least about 45 oersteds.

5. The thin magnetic strip of claim 4 having a residual induction of at least 9000 gauss.

6. An electronic article surveillance system utilizing an improved ferrous alloy magnetic component, said component comprising a thin magnetic strip having a thickness of between 0.0005 and 0.003 inches, said strip consisting essentially of iron, from about 0.45 to about 0.7 weight percent carbon, from about 2.5 to about 7 weight percent chromium, from about 0.1 to about 2 weight percent molybdenum, and optionally from about 0.05 to about 0.7 weight percent vanadium, from about 0.3 to about 1.2 weight percent manganese, and from about 0.3 to about 1 weight percent silicon, and being essentially free of cobalt, said strip having a coercive level of at least about 35 oersteds and a residual induction of at least 7,000 gauss.

7. The electronic article surveillance system of claim 6 wherein said strip has a coercive level of at least 40 oersteds.

8. The electronic article surveillance system of claim 7 wherein said strip has a residual induction of at least 9000 gauss.

* * * * *